United States Patent [19]

Moore, Sr., deceased et al.

[11] 4,271,809

[45] Jun. 9, 1981

[54] VAPORATOR

[76] Inventors: Theodore G. Moore, Sr., deceased, late of Yoncalla, Oreg.; by Theodore G. Moore, Jr., administrator, 1519 1st Ave., Rockford, Ill. 61108; by Betty L. Moore, administrator, 509 NW. Franklin, Bend, Oreg. 97701

[21] Appl. No.: 876,060

[22] Filed: Jun. 27, 1978

[51] Int. Cl.[3] ..... F02M 31/00

[52] U.S. Cl. ..... 123/522; 123/557; 123/558

[58] Field of Search ..... 123/133, 134, 3, 34 A; 261/119, 121 A, 122 B

[56] References Cited

U.S. PATENT DOCUMENTS

| | | | |
|---|---|---|---|
| 793,786 | 7/1905 | Helme | 123/134 |
| 860,522 | 7/1907 | Brown | 123/134 |
| 1,530,882 | 3/1925 | Chapin | 123/134 |
| 1,966,345 | 7/1934 | Harrell | 123/3 |
| 3,713,429 | 1/1973 | Dwyre | 123/134 |

*Primary Examiner*—Ronald H. Lazarus

[57] ABSTRACT

A internal combustion engine fuel vaporizing device, including a vaporator tank assembly and air mixture assembly, connect by a tube. The vaporizing device consists of a fuel intake and float mechanism, a number of air intakes, some of which may include the catalytic device attachment and supplemental heater coils and a non-volatile particle reservoir. The air mixture consists of an air intake, two anti-backfire devices, a baffle system and a throttle mechanism.

1 Claim, 1 Drawing Figure

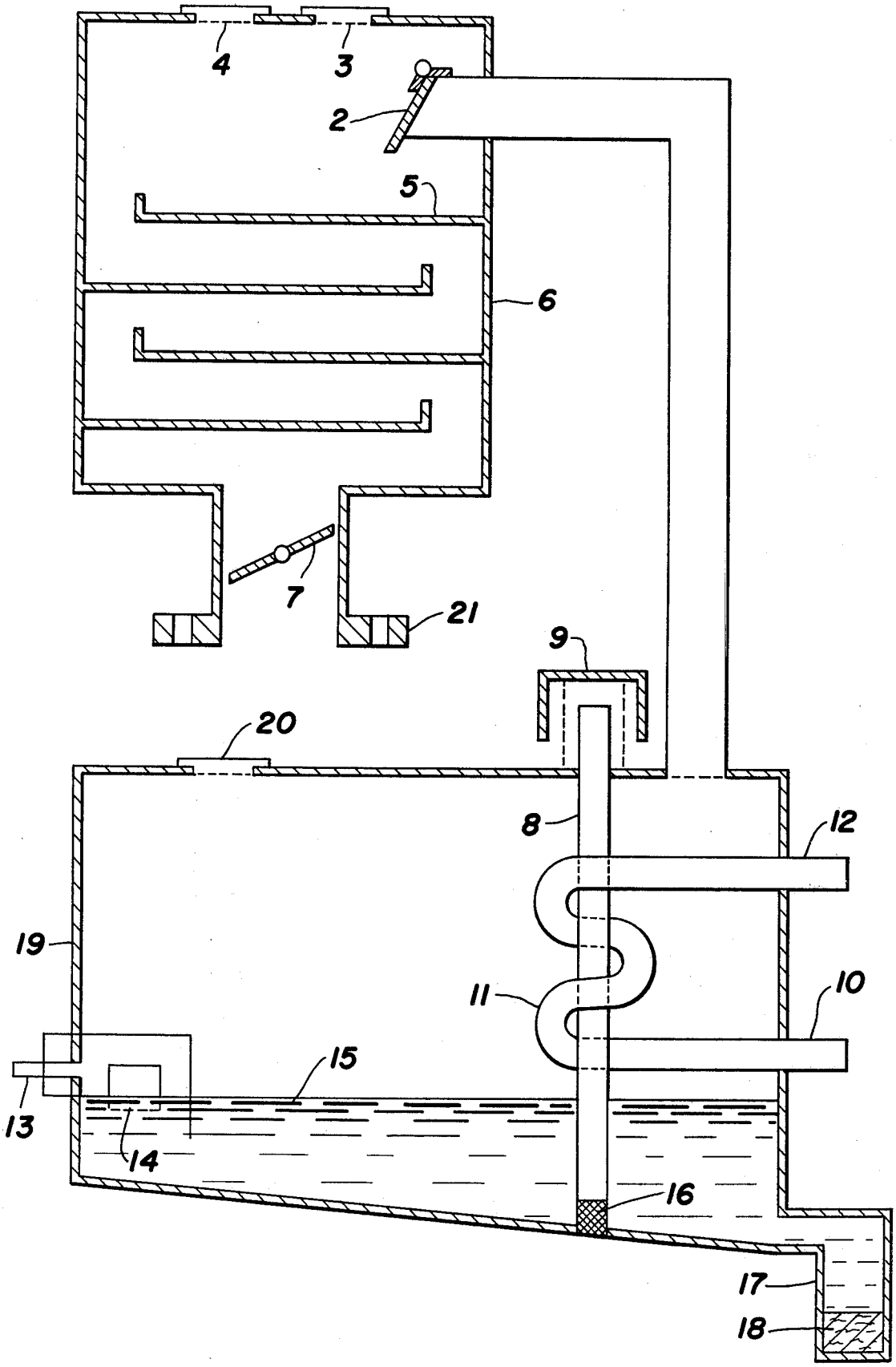
4
3
2
5
6
7
21
9
20
8
12
19
11
10
15
13
14
16
17
18

VAPORATOR

This invention relates to fuel vaporizing systems for internal combustion engines, particularly used on motor vehicles.

The object of this invention is to provide improved combustion of the gasoline along with improved engine efficiency mileage, using only several moving parts and to replace existing carburetor systems.

A further object of the invention, being inexpensive and reliable to operate, is to reduce harmful emission of pollutants and unburned fumes, including carbon monoxide as found in existing fuel systems, by vaporizing gasoline by means of bubbling action of intake air warmed by the engine cooling system through an air inlet tube to the bottom of which is attached a porous zinc catalyst device which is immersed in the liquid gasoline. The catalytic action "cracks" the heavy hydrocarbons chains off of the gasoline, letting the more volatile hydrocarbons evaporate quickly. These lighter hydrocarbons will combust more completely, giving off fewer emission pollutants into the atmosphere.

A further object of this invention is to provide for the collecting of non-volatile particles in a reservoir compartment which can be cleaned as needed.

A still further object of this invention is to provide anti-backfire means to prevent the ignition of the gasoline in the vaporator and further to provide a baffle system to further mix the air and fuel vapor.

Further objects and advantages of this invention will become apparent from the following description and claims taken in connection with the single FIGURE, the FIGURE being a diagrammatic view of a typical vaporizer systems.

Referring to the drawing, when the throttle valve 7 is opened, air is drawn thru air intakes 9 into the vaporator chamber 19 through the intake pipe 8, to which is connected a porous zinc catalytic device 16.

As the incoming air passes up through the liquid gasoline 15 it causes the gasoline to vaporize and mix with the air along with additional air entering thru the auxiliary air intake 20 mounted on the top of vaporator chamber 19.

The air-gas vapor passes through the connecting pipe 1 into the mixing compartment 6, past the baffles 5, to further blend the mixture before passing the throttle valve 7 and through the intake manifold 21 and into the engine where the air-gas vapor mixture ignites.

Further, inside the mixing compartment 6, an anti-backfire valve 2 or similar device is attached to the connecting pipe 1 to prevent: (a) the ignition of the air-gas vapor mixture in the vaporator chamber 19 and (b) to prevent the increased pressure from forcing the liquid gasoline up the air intake pipe 8 and out onto the outside of the engine, increasing the fire hazard.

In addition to the anti-backfire valve 2 the mixing chamber 6 has an air outlet device 3 to release the back pressure of a backfire and/or an air intake valve 4 to add additional air to the mixture. Items 3 and 4 can be combined. The air intake valves 4 and 20 could include air filters.

Inside the vaporator chamber 19 the liquid level 15 is maintained by means of a float mechanism 14 which operates liquid gasoline input 13. The liquid level 15 is to maintained above the porous zinc catalyst device 16 which is attached to the air intake pipe 8. The porous zinc catalyst device 16 is used to separate the heavy hydrocarbons from the light gasoline ends which evaporate easier and combust more completely, giving off fewer pollutants into the atmosphere.

The heavy hydrocarbons and other heavy particles 18 are to collected in the particle reservoir 17 which can be removed for cleaning as needed. To help the gasoline evaporate it is beneficial to keep it warm. This can be accomplished by means of the engine cooling system liquid which enters into the fluid intake 10 passes around the air intake pipe 8 by means of the coil 11 and finally out through the fluid outlet 12.

In addition to my brief description and detailed description, vaporator may be used on a diesel engine, but without air intake valve on air mixing chamber 6.

It is understood that modifications withing the idea of the invention may occur to those skilled in the art and still be within the scope of the invention.

What is claimed is:

1. An internal combustion engine vaporator system comprising:

a vaporator tank which provides an enclosed chamber for containing a liquid fuel, means for supplying liquid fuel to said chamber;

float means for maintaining a specified level of liquid fuel in said vaporator tank;

an air inlet tube extending below the level of the liquid fuel;

a porous zinc catalyst device positioned completely below the level of the liquid fuel and attached to said tube;

said catalytic device being provided to separate the light gasoline ends from the heavy hydrocarbons, the lighter ends vaporizing quickly into the air bubbling up through the fuel from the air inlet tube, and the non-volatile parts collecting in a particle reservoir means on the bottom of the vaporator tank, said reservoir being removable for cleaning, a heating coil wrapped around the tube, said heating coils being heated by engine coolant tapped from the engine cooling system, said heating coils enhancing the evaporation process;

an auxilliary air inlet provided in said vaporator tank and including a valve therein for controlling additional air as needed;

an air-fuel mixing chamber means;

air-fuel conduit means for connecting said vaporator tank to said air-fuel mixing chamber means;

a backfire valve device;

said air-fuel conduit means including said backfire valve device to prevent liquid fuel from being expelled from the vaporator tank in the event of a backfire;

an additional air inlet/outlet device provided for the air-fuel mixing chamber means in order to add more air and allow release of backfire pressure, a system of baffle plates positioned in the air-fuel mixing chamber to further mix the air and gas vapor; and a conduit connected to and extending between the air/fuel mixing chamber and the intake manifold of the engine to allow the fuel/air mixture to flow to the combustion chambers.

* * * * *